US008322058B2

(12) United States Patent
Mayer et al.

(10) Patent No.: US 8,322,058 B2
(45) Date of Patent: Dec. 4, 2012

(54) TELESCOPING GREETING CARDS WITH ACTIVATED SOUND OR LIGHT OR MECHANICAL FUNCTIONS

(75) Inventors: David Mayer, Bay Village, OH (US); Allison Marsh, Ravenna, OH (US); Kimberly Bikowski, Avon, OH (US); David Sapp, North Ridgeville, OH (US); Tiger Qiao, Shanghai (CN); Catherine Liu, Shanghai (CN); Coco Zhang, Shanghai (CN); Jerry Guo, Shanghai (CN)

(73) Assignee: American Greetings Corporation, Cleveland, OH (US)

( * ) Notice: Subject to any disclaimer, the term of this patent is extended or adjusted under 35 U.S.C. 154(b) by 129 days.

(21) Appl. No.: 12/974,287

(22) Filed: Dec. 21, 2010

(65) Prior Publication Data

US 2011/0146117 A1 Jun. 23, 2011

Related U.S. Application Data

(60) Provisional application No. 61/288,960, filed on Dec. 22, 2009.

(51) Int. Cl.
*G09F 11/00* (2006.01)

(52) U.S. Cl. ..... 40/491; 40/124.03

(58) Field of Classification Search ..... 40/124.01–124.191; 446/147–152; 229/92.8
See application file for complete search history.

(56) References Cited

U.S. PATENT DOCUMENTS

| | | | | | |
|---|---|---|---|---|---|
| 2,524,965 | A * | 10/1950 | Eddy | 40/382 |
| 3,286,383 | A * | 11/1966 | Osher | 40/534 |
| 3,757,934 | A * | 9/1973 | Taub | 206/768 |
| 4,934,079 | A * | 6/1990 | Hoshi | 40/427 |
| 6,532,691 | B2 * | 3/2003 | Carlin et al. | 40/491 |
| 6,643,961 | B1 * | 11/2003 | Hluchan | 40/492 |
| 7,707,757 | B2 * | 5/2010 | Crowell | 40/491 |
| 7,861,441 | B1 * | 1/2011 | Hoellwarth | 40/124.06 |
| 7,882,651 | B2 * | 2/2011 | Wilen | 40/124.06 |
| 8,011,122 | B2 * | 9/2011 | Clegg et al. | 40/124.03 |
| 8,176,663 | B2 * | 5/2012 | Sapp et al. | 40/124.03 |
| 2011/0146117 | A1 * | 6/2011 | Mayer et al. | 40/124.03 |

* cited by examiner

*Primary Examiner* — Tashiana Adams
*Assistant Examiner* — Shin Kim
(74) *Attorney, Agent, or Firm* — James C. Scott; Roetzel & Andress

(57) ABSTRACT

A telescoping greeting card having a plurality of pockets and/or panels that are connected in sequence and configured to slidably telescope between a closed position wherein each of the pockets and/or panels are contained within a main panel and an open position wherein each of the pockets and/or panels are extended in a longitudinal array. The greeting card additionally contains a switch and a sound module with at least one pre-recorded audio file that may be played back upon removal of one of the panels or pockets of the greeting card, which triggers the switch.

14 Claims, 7 Drawing Sheets

TELESCOPING GREETING CARDS WITH ACTIVATED SOUND OR LIGHT OR MECHANICAL FUNCTIONS

RELATED APPLICATIONS

This application claims priority to U.S. Provisional Patent Application No. 61/288,960 filed on Dec. 22, 2009, which is incorporated herein by reference in its entirety.

FIELD OF THE INVENTION

The present disclosure and related inventions pertain to greeting cards and more specifically to telescoping greeting cards with sound-producing and multi-media functions.

BACKGROUND OF THE INVENTION

Conventional paper greeting cards are widely used for celebratory occasions such as birthdays, graduations, weddings, and for other communication and social expression purposes. Traditional text information is generally found on paper greeting cards. More recently, sound has been added to traditional paper greeting cards, in the form of electrically powered compact circuits with pre-recorded messages and music to increase the entertainment value of cards by delivering an audio message that is electronically embodied in circuitry that is carried by or contained within the greeting card, such as between panels or pages of the card. The ability to use sound in combination with printed matter such as with conventional printed greeting cards significantly enhances the entertainment and communicative value of social and relational greetings. The use of popular music and media has made sound-generating greeting cards increasingly popular. Conventional style greeting cards are most commonly "gate-folded" in the manner of a book, with a front panel connected along a fold line to a back panel, each panel having a front and back side.

SUMMARY OF THE INVENTION

In one aspect of the present invention, a telescoping greeting card is described having a first pocket, a second pocket configured to be contained within and slidably attached to the first pocket, a third pocket configured to be contained within and slidably attached to the second pocket, a first panel configured to be contained within and slidably attached to the third pocket, a sound module operative to store at least one pre-recorded audio file and playback said at least one pre-recorded audio file, the sound module being contained and concealed within the first pocket, and a switch contained within the second pocket. The greeting card is operative to telescope between a closed position in which the second and third pockets and first panel are each contained within the first pocket and an open position wherein the second and third pocket and first panel are fully extended outside of the first pocket. The switch is triggered by removing the second pocket from the first pocket, initiating playback of the at least one pre-recorded audio file contained within the sound module.

In another aspect of the invention, a telescoping greeting card is described as having a greeting card body comprising a panel slidably engaged with and nested within a third pocket, the third pocket slidably engaged with and nested within a second pocket, the second pocket slidably engaged with and nested within a first pocket, a sound module comprising a circuit board, an integrated circuit, a power source, a memory chip, a speaker and at least one pre-recorded audio file contained on the memory chip, and a light sensitive switch. To open the greeting card from a closed position, the panel is removed from the third pocket, the third pocket is removed from the second pocket and the second pocket is removed from the first pocket. The light sensitive switch and sound module are contained within the greeting card body and the light sensitive switch triggers the sound module to play the at least one pre-recorded audio file when it is exposed to a change in the amount of light detected by the switch.

In still another aspect of the invention, a telescoping greeting card is described having a main pocket with a front panel, a back panel and three side panels that extend between the front and back panels, the main greeting card being open along one side of the pocket, a second pocket having a front panel, a back panel, the front and back panels being connected along three sides and a fourth side being open, a third pocket having a front panel, a back panel, the front and back panels being connected along three sides and a fourth side being open, and a panel having a front side and a back side. The main pocket is directly engaged with the second pocket, the second pocket is directly engaged with the third pocket, and the third pocket is directly engaged with the panel. The second panel fits within the main pocket with a substantial portion of the second pocket capable of being slidably removed form the main pocket. The third pocket fits within the second pocket with a substantial portion of the third pocket capable of being slidably removed from the second pocket. The panel fits within the third pocket with a substantial portion of the panel capable of being slidably removed from the third pocket. The greeting card is operative to play at least one pre-recorded audio file upon the removal of the second pocket from the main pocket.

DETAILED DESCRIPTION OF PREFERRED AND ALTERNATE EMBODIMENTS

The telescoping greeting cards 100 of the present disclosure and related inventions have sound, light, vibration, electronic media or other functions, including sound-generating circuitry and mechanisms which are activated in various ways related to the structure of the greeting card, and using either mechanical, light or magnetically activated or switched circuits.

The greeting card body includes a plurality of telescoping pockets or panels which telescope in an inward and outward direction with respect to one another. The first or main pocket or receptacle 10 serves as the outer surface of the greeting card and is therefore the largest of the pockets or panels of the greeting card. All of the remaining pockets or panels are sized to fit within the first or main pocket 10. After the first or main pocket 10, each successive pocket or panel is slightly smaller in size than the previous pocket or panel such that each successive pocket or panel fits within the previous pocket.

Figure 4:
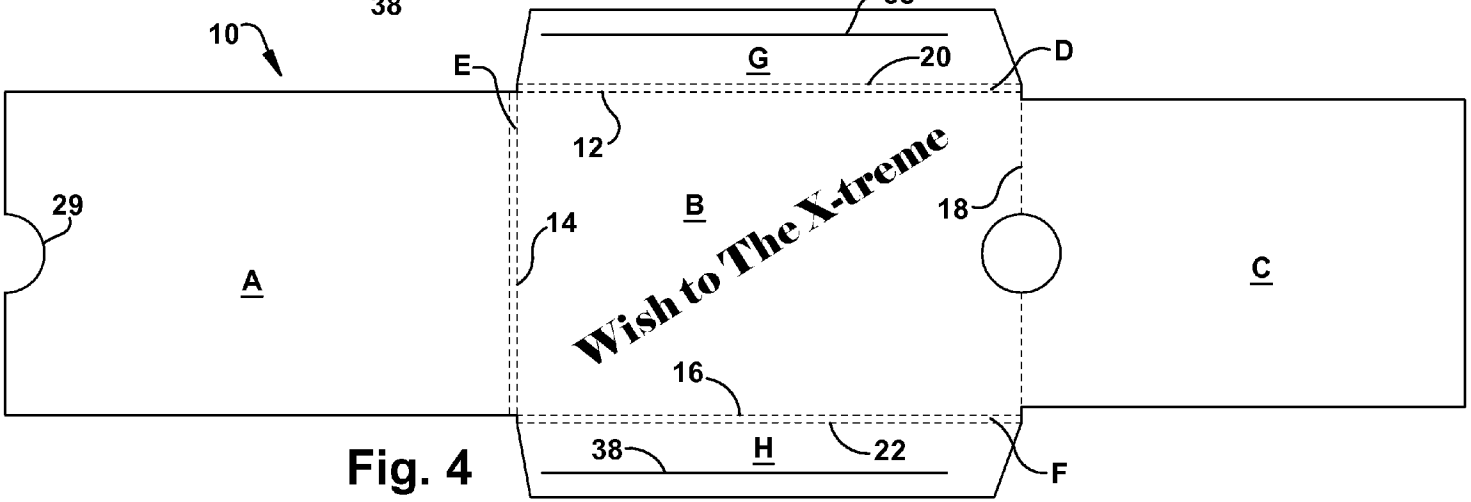
FIG. 4 is a representative die cut of the outer pocket of the greeting card.

The construct of the first or main pocket 10, as shown in FIG. 4, includes three substantially rectangular panels A, B, C, three elongate side panels D, E, F and two slide tab panels G, H. Each panel contains a front or outer surface and a back or inner surface. The outer surface of each panel is shown in FIG. 4. Main panel B serves as the front panel of the greeting card. It may contain various artwork, photographs and/or text sentiment printed on the front or outer surface thereof. Panel B is substantially rectangular and is connected to the three elongate side panels D, E, F, which serve as side walls of the main greeting card pocket 10. Panel B is connected to side panel D along fold line 12, to side panel E along fold line 14 and to side panel F along fold line 15. Panel B is also connected to an auxiliary panel C along fold line 18. Side panel E is connected to panel A along fold line 25. Panel A serves as the back side or back outer surface of the main pocket 10. It contains a small notch 29 in a free short edge of the panel, which provides access to the inner panels by for example, a user gripping an inside panel between a thumb and forefinger. Panel A may also contain various artwork, photographs and/or text sentiment printed thereon. Card instructions may also he printed thereon. Two of the elongate side panels D, F are connected to the two slide tab panels G, H. Side panel D is connected to slide tab panel G along fold line 20 and side panel F is connected to slide tab panel H along fold line 22. The slide tab panels G, H are substantially rectangular, each having a slot 38 or elongate opening thereon. The slits facilitate engagement between card pockets and/or panels.

Electronics and related circuitry, described in further detail below, are attached to the back or inside surface of panel B. Once the appropriate electronics have been attached, adhesively or otherwise, to the back or inside surface of panel B, panel C is folded along fold line 18 to overlie or face panel B, thereby concealing the electronic components between panels B and C. Panel C may be attached to panel B using adhesive or any other attachment mechanism. Side panels D and F are folded along fold lines 12 and 16 respectively and again along fold lines 20 and 22 respectively, such that the slide tab panels G, H are in a perpendicular arrangement with respect to side tabs D and F and a parallel arrangement with panel B. The slide tab panels G, H are spaced apart from panel B in an amount equal to the width of side panels D and E. Side panel E and panel A remain Lin folded until all of the remaining greeting card pockets or panels are engaged with each other, beginning with the main pocket 10.

Figure 3:
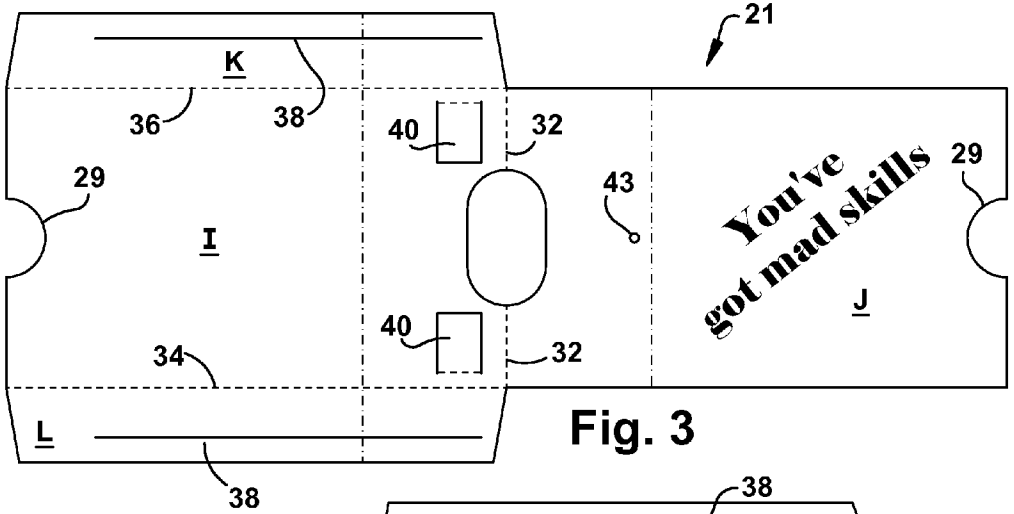
FIG. 3 is a representative die cut of the second inner pocket of the greeting card.

A representative die cut of the second 21 and third pockets 31 is shown in FIGS. 3 and 4. The second 21 and third 31 pockets are substantially similar, having two main panels I, J which are connected along fold tine 32. The only difference between the second 21 and third 31 pockets is that the third pocket is slightly smaller in size that the second pocket so that the third pocket 31 can easily fit within the second pocket 21. The second 21 and third 31 pockets do not contain side panels such as side panels D, E and F described above with respect to the first pocket 10. The two main panels I, J of the second 21 and third 31 pockets are folded onto each other and closed along three side edges forming a cavity therein. However, the cavity is much smaller than the cavity contained within the first or main pocket 10 due to the side panels D, E, F separating the main panels of the pocket 10 from each other. Further describing the second 21 and third 31 pockets, panel J is a substantially rectangular panel having a notch 29 at the center of one free edge of the panel. The notch 29 in panel J corresponds to or lines up with the notch 29 on panel A of the main pocket 10 and is used to facilitate removal of the inner panels. Panel I is connected to slide tab panel K along fold line 36 and to slide tab L along fold line 34. Each of the slide tab panels K, L, as described above with respect to side tab panels G and H, contains an elongate slot 38 or opening thereon which is used to facilitate engagement of the pocket with other pockets or panels of the greeting card. The slot 38 extends over a substantial portion of each of the slide tab panels K, L but does not extend to the edge of the panel K, L. Panel I also contains a notch 29 along a free edge of the panel which corresponds or lies up with the notch 29 located on panel J and also panel A, as described above. Additionally, panel I contains two square or rectangular engagement tabs 40 which are part of the body of panel I, being separated along three edges and connected to panel I along one edge. These engagement tabs 40 are used along with the slide tab panels of an adjacent pocket. For example, the engagement tabs 40 of the second pocket 21 are inserted into slide tab panels G and H located on the first pocket 10. The engagement tabs slide along the slot or opening in the slide tab panels and prevent the complete removal of each pocket or panel from the previous pocket.

Figure 1:
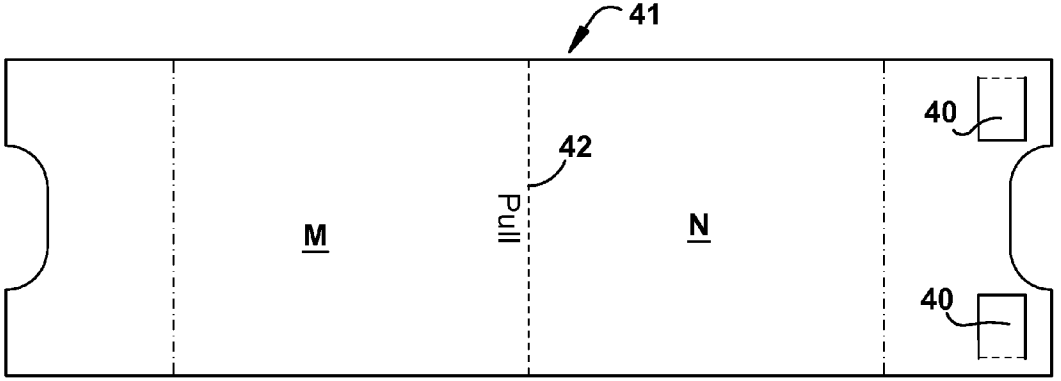
FIG. 1 is a representative die cut of the fourth inner panel of the greeting card.
Figure 2:
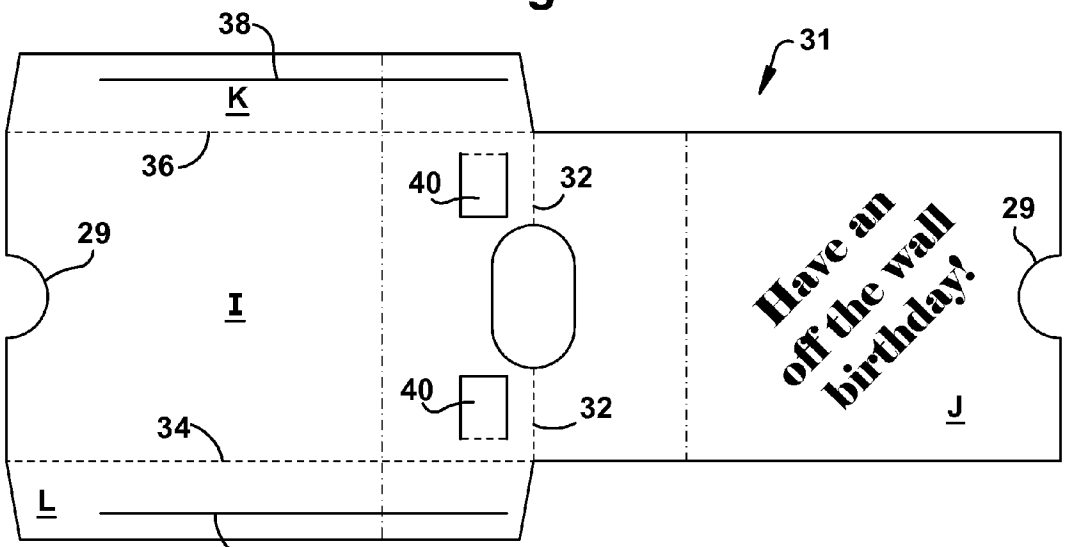
FIG. 2 is a representative die cut of the third inner pocket of the greeting card.

A representative die cut of a fourth panel 41 of the greeting card is shown in FIG. 1. The fourth panel 41 is the final or last component of the greeting card to be removed from the main cavity or pocket 10 and subsequent pockets 21, 31. Being that it is the last component, it is configured as a panel and not a pocket because it does not need to house any subsequent pockets or panels. The fourth panel 41 contains two main panels M, N. The panels M, N are substantially rectangular and are attached via a fold line 42. Panels M and N both contain a notched edge along one side of each panel, which correspond to each other once the panel is folded along fold line 42 so that the inner surface of panels M and N overlie each other. Panel N contains two engagement tabs 40, which as described above are used to engage the panels or pockets with the previous pocket. For example, the engagement tabs 40 located on panel N of the fourth panel 41 are inserted into the slots 38 in panels K and L of the third pocket 31 so that the fourth panel 41 can be fully inserted into the third pocket 31 and it can be removed by pulling the fourth panel 41 until the engagement 40 tabs reach the end of the slots 38 in panels K and L. This prevents the fourth panel 41 from being completely removed from the third pocket 31.

Figure 5:
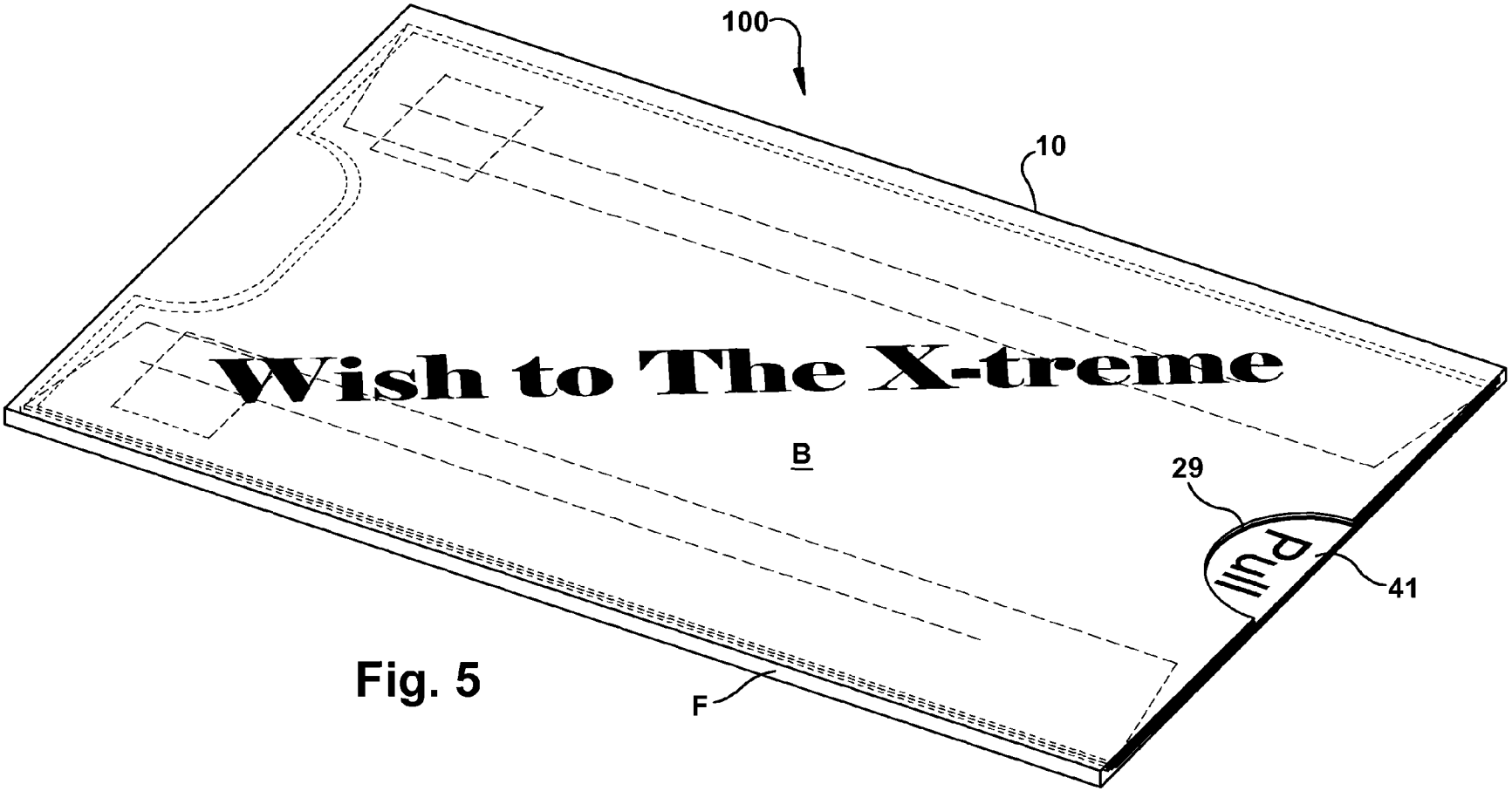
FIG. 5 is a perspective view of the greeting card in a first position.
Figure 6:
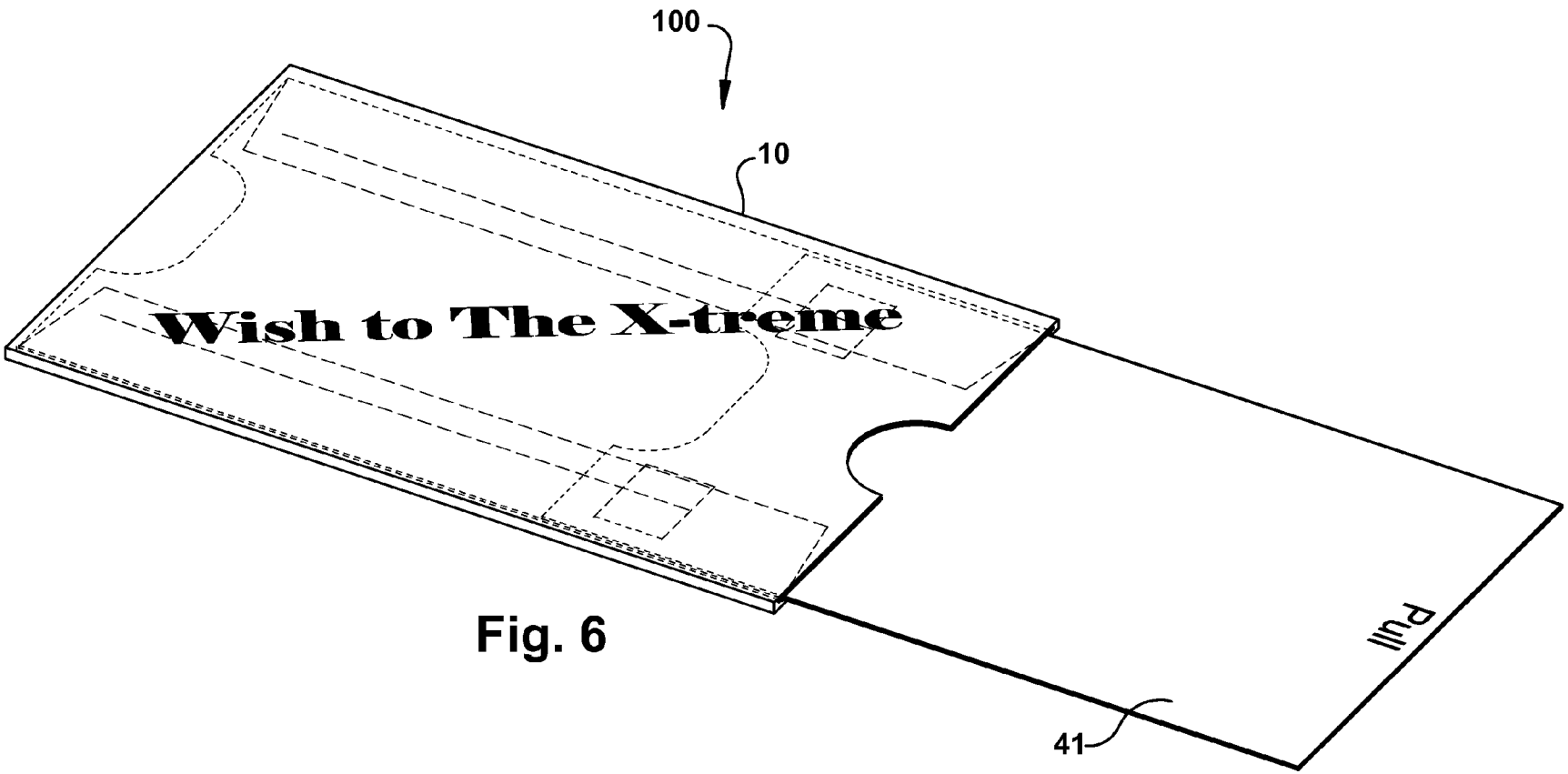
FIG. 6 is a perspective view of the greeting card in a second position.
Figure 7:
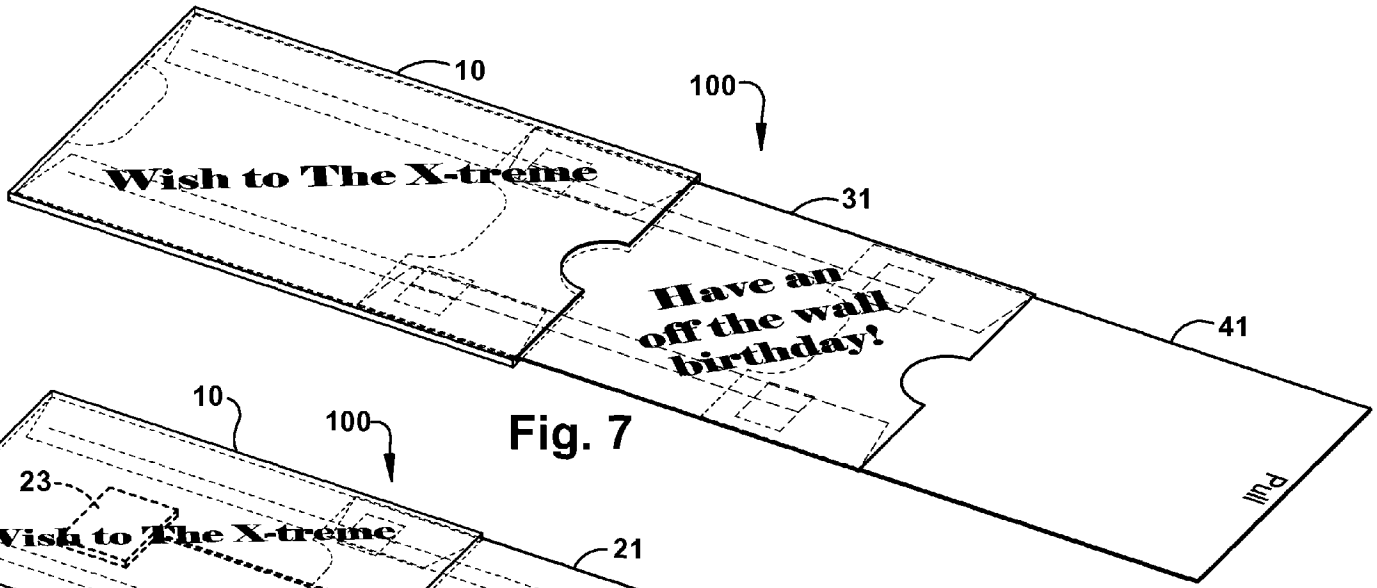
FIG. 7 is a perspective view of the greeting card in a third position.
Figure 8:
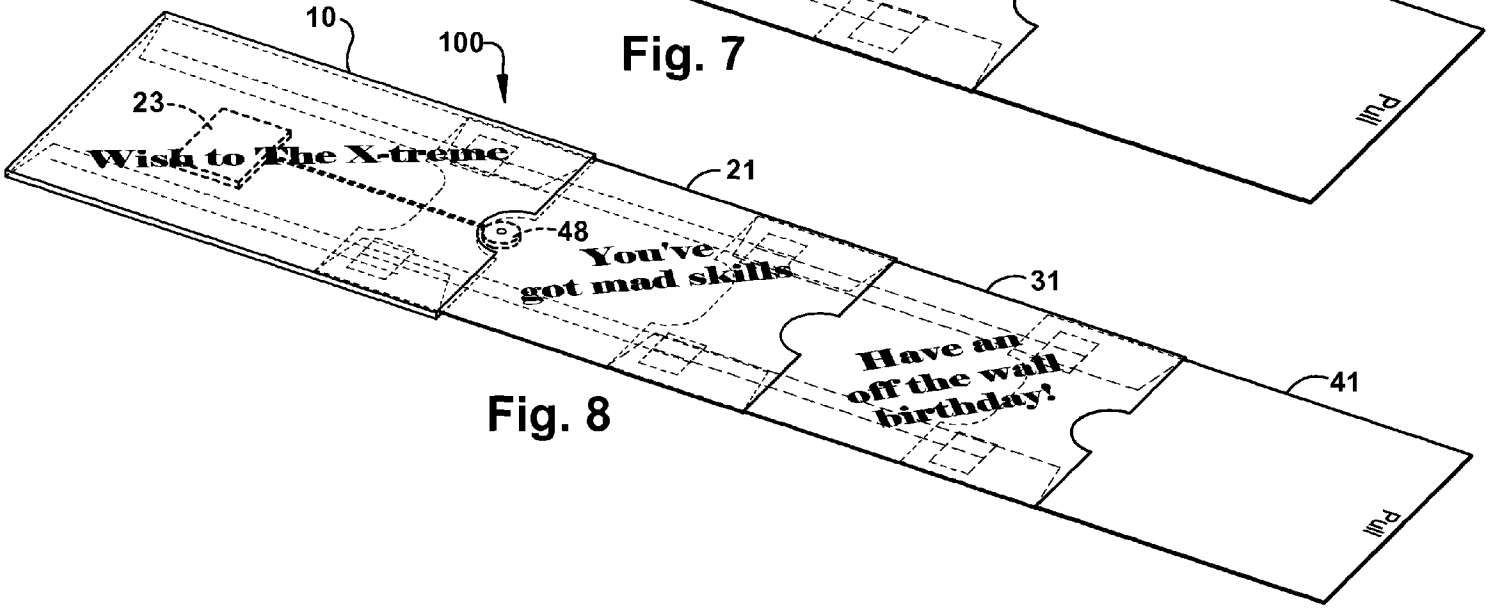
FIG. 8 is a perspective view of the greeting card in a fourth position.
Figure 9:
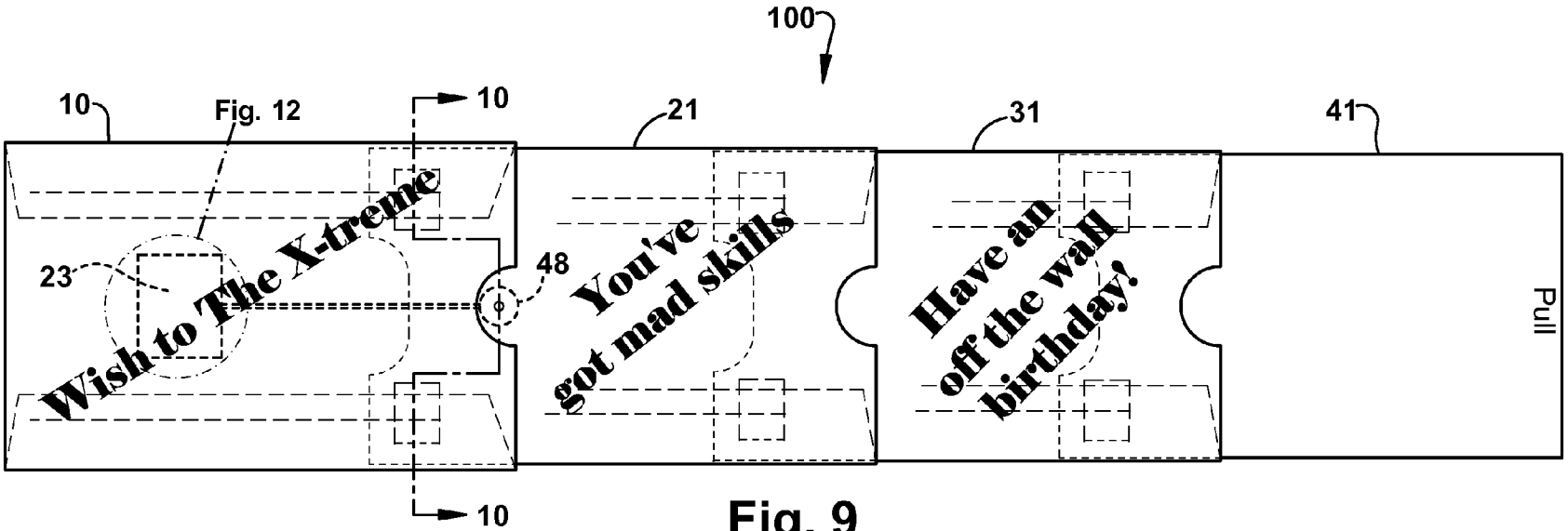
FIG. 9 is apian view of the greeting card in the fourth position.

FIG. 5 shows a perspective view of the greeting card in a first position wherein all pockets and panels are substantially concealed within the main pocket 10. A small portion of the fourth panel 41 can be seen between the notch 29 located along one end of the main pocket 10. This portion is visible so that a user can grip the fourth panel 41 perhaps between a thumb and forefinger to pull the panel 41 out from within the main pocket 10. Therefore, the fourth panel 41 or last component is the first to be removed from the main pocket 10, as shown in FIG. 6. While the fourth panel 41 is removed by pulling the panel away from the main pocket 10, the engagement tabs 40, which are inserted into the slots 38 located on both sides of the third pocket 31, slide along the slots 38 until the engagement tabs 40 reach the end of each slot 38. Once the engagement tabs 40 of the fourth panel 41 reach the end of the slots 38 of the third pocket 31, and additional force is applied away from the main pocket 10, the fourth panel 41 pulls the third pocket 31 from within the main pocket 10 and the second pocket 21, as shown in FIG. 7. The engagement tabs 40 of the third pocket 31, which are inserted into the slots 38 located on opposite sides of the second pocket 21, slide along the slots 38 until reaching the end of the slot 38. If a user continues to pull the fourth panel 41, the engagement tabs 40 of the third pocket 31 pull the second pocket 21 out from within the main pocket 10. This configuration is shown in FIGS. 8 and 9, wherein all pockets/panels are revealed outside the main pocket 10. Each of the panels or pockets may contain printed text sentiment, artwork, photographs or other indicia printed thereon.

Figure 10:
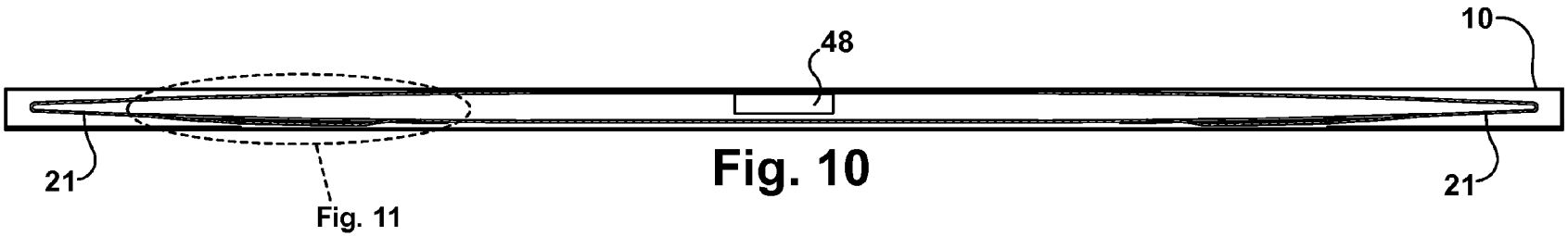
FIG. 10 is a cross-sectional view of the greeting card of FIG. 9 in the direction of arrows 10-10.
Figure 11:
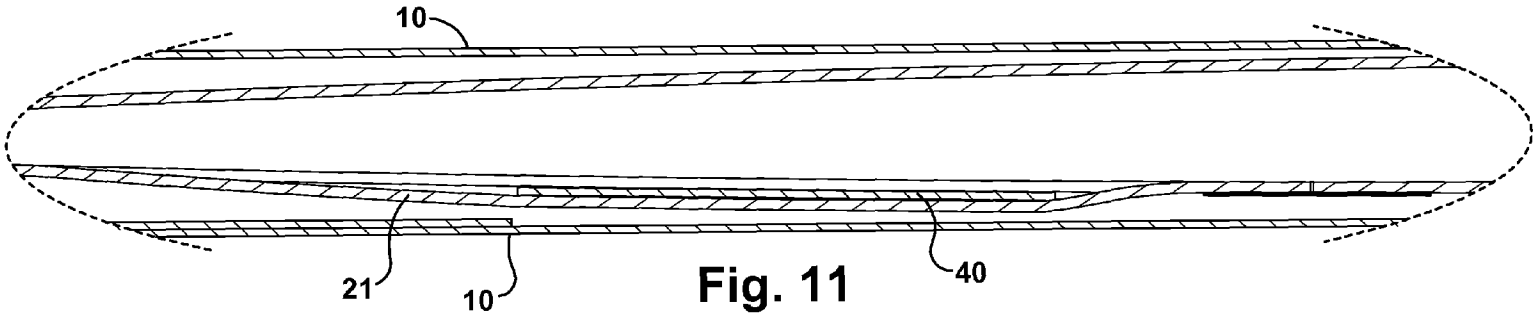
FIG. 11 is a close up view of a portion of FIG. 10 showing the engagement of the panels.
Figure 12:
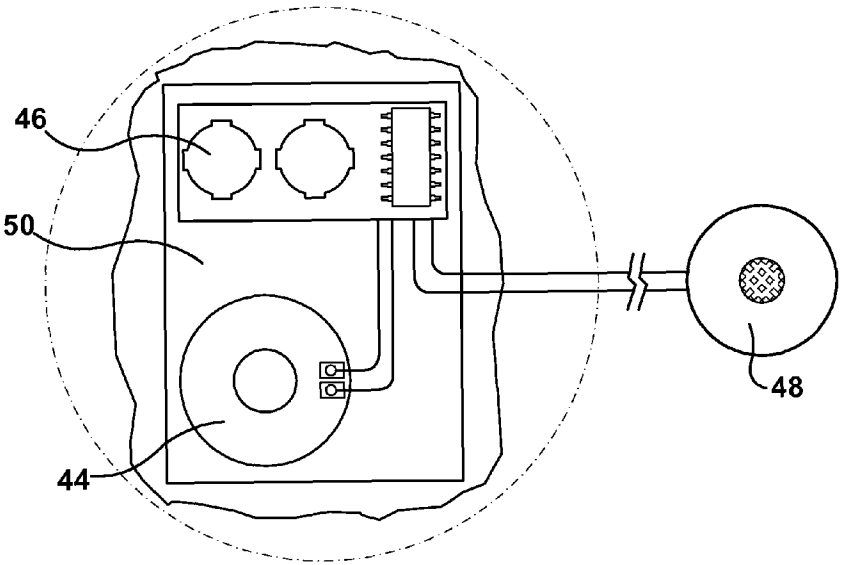
FIG. 12 is a cutaway view of a representative sound module.

The main pocket 10 of the greeting card contains and conceals electronic components of a sound module 23 such as a speaker 44, circuit board 50, an integrated circuit 48, a processor, power source 46 and related circuitry, as shown in FIG. 12. One or more pre-recorded audio files may be stored within memory. The audio files may contain music, a voice message, sounds or a combination thereof. Other components may be coupled with the circuit board and various configurations of components including additional integrated circuits, memory chips etc., which are readily understood by one skilled in the art, are considered to be within the scope of this invention. A light sensitive activation switch 48 is located within the second pocket 21 of the greeting card. The light sensor 48 operates by a change in the amount of light detected by the sensor. When the sensor 48 detects a change, it sends a signal to the sound module 23 to initiate the audio files. The light sensor 48 detects light through a small hole or aperture 43 located on the top surface of the second pocket 21 of the greeting card. When the second pocket 21 is in a position wherein it is fully contained within the main pocket 10, the sensor 48 does not detect any light. Once the second pocket 21 is removed from within the main pocket 10, the sensor 48 detects a change in the amount of light, thereby triggering the audio. The sensor switch 48 and engagement between the first 10 and second 21 pockets is detailed in FIGS. 10 and 11. Since the second pocket 21 is the last component to be revealed, the audio is not triggered until all components of the greeting card are exposed, as shown in FIGS. 8 and 9.

Although a light sensitive activation switch is described herein, other types of sensor may be used such as: a mechanical contact arm switch located within the main panel of the greeting card that triggers audio once the last or second pocket has been removed from within the contact arm; or a magnetic switch wherein a small magnet is contained within two of the greeting card pockets such that when the panels are moved away from each other, the magnets break contact thereby triggering the playing of the audio files. Other such switch mechanisms, known to one skilled in the art, are considered to be within the scope of this invention. Also, the switch mechanism may be contained in any of the described pockets of the greeting card.

In another embodiment, the greeting card may additionally contain components for recording and playback capability. One of the panels or pockets of the greeting card may contain a push button switch which would initiate a sound recording session by which a user would record a personalized message to be saved in memory. The user-recorded message would then be played when the trigger mechanism activates the sound module 23. A combination of pre-recorded sound files and user-recorded sound files may be used as well.

In addition to activating sound, the greeting card may also trigger other features in addition to or in place of sound, including lights, vibration or electronic media. One or more LED lights may be placed within small openings located in various pockets or panels of the greeting card so that when the trigger mechanism is activated, the lights are turned on. Various other mechanical mechanisms in combination with moveable components of the greeting card may be initiated by the trigger mechanism to vibrate, oscillate, rotate, or move in a lateral up and down motion.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A telescoping greeting card comprising:

a first pocket;

a second pocket contained within and slidably attached to the first pocket;

a third pocket contained within and slidably attached to the second pocket;

the first, second and third pockets being substantially rectangular and having three closed sides and one open side;

a first panel contained within and slidably attached to the third pocket;

a sound module contained within the first, second or third pocket, which is operative to store and playback at least one pre-recorded audio file;

a light sensitive switch contained within the first, second or third pocket, which is operative to control playback of the at least one pre-recorded audio file;

wherein the greeting card is operative to telescope between a closed position in which the second and third pockets and first panel are each contained within the first pocket and an open position wherein the second and third pockets and first panel are each substantially extended outside of the first pocket; and wherein the light sensitive switch is triggered by removing the second pocket, third pocket or first panel from the first pocket, initiating playback of the at least on pre-recorded audio.

2. The telescoping greeting card of claim 1, wherein a portion of the first panel is visible when the greeting card is in the closed position.

3. The telescoping greeting card of claim 1, wherein the first pocket contains a front panel, a back panel parallel and spaced apart from the front panel, and three side panels which are perpendicular to and extend between the front panel and the back panel.

4. The telescoping greeting card of claim 1, wherein the second and third pockets contain a front panel and a back panel which is parallel to the front panel, the front and back panels being attached along three sides.

5. The telescoping greeting card of claim 1, wherein the light sensor is activated upon detecting a change in the amount of light detected.

6. The telescoping greeting card of claim 5, wherein the light sensor is partially visible through a front panel of the second or third pocket through a small aperture contained thereon.

7. The telescoping greeting card of claim 1, wherein the first, second and third pockets each contain two elongate slots.

8. The telescoping greeting card of claim 7, wherein the second and third pockets and first panel each contain two engagement tabs for engagement with the two elongate slots contained within the first, second and third pockets, respectively.

9. A telescoping greeting card comprising:

a main pocket having a front panel, a back panel and three side panels that extend between the front and back panel, the main pocket being open along one side of the pocket;

a second pocket having a front panel, a back panel, the front and back panels being connected along three sides creating a cavity therebetween and a fourth side being open, the second pocket located within and substantially removable from the main pocket;

a third pocket having a front panel, a back panel, the front and back panels being connected along three sides creating a cavity therebetween and a fourth side being open, the third pocket located within and substantially removable from the second pocket;

a panel having a front side and a back side, the panel located within and substantially removable from the third pocket;

wherein the greeting card is operative to play at least one pre-recorded audio file upon the removal of the second pocket from the main pocket.

10. The telescoping greeting card of claim 9, wherein the main pocket contains and conceals a sound module and related circuitry.

11. The telescoping greeting card of claim 9, wherein a light sensor is contained within the main pocket, the second pocket or the third pocket, the light sensor triggering a switch to initiate playback of the at least one pre-recorded audio file.

12. The telescoping greeting card of claim 9, wherein the second pocket cannot be completely removed from the main pocket, the third pocket cannot be completely removed from the second pocket, and the panel cannot be completely removed from the third pocket.

13. The telescoping greeting card of claim 9, wherein the main pocket, second pocket, third pocket and panel each contain a portion of a text greeting.

14. The telescoping greeting card of claim 9, wherein the greeting card is substantially rectangular.

* * * * *